US005867903A

United States Patent [19]

Loughlin

[11] Patent Number: 5,867,903

[45] Date of Patent: Feb. 9, 1999

[54] METHOD OF MANUFACTURING A CROSS FROM RINGS

[76] Inventor: John P. Loughlin, 28 S. Bower St., Shenandoah, Pa. 17976

[21] Appl. No.: 858,112

[22] Filed: May 19, 1997

[51] Int. Cl.[6] ..... B21F 1/02

[52] U.S. Cl. ..... 29/896.41; 63/21; 63/23

[58] Field of Search ..... 29/896.4, 896.41, 29/896.412; 63/1.16, 21, 23, 33, 35

[56] References Cited

U.S. PATENT DOCUMENTS 2,721,398 10/1955 Alonso et al. ..... 63/33

3,415,079 12/1968 Tomchin ..... 63/23

FOREIGN PATENT DOCUMENTS 69161 6/1915 Austria ..... 63/2

*Primary Examiner*—P. W. Echols

*Attorney, Agent, or Firm*—Synnestvedt & Lechner

[57] ABSTRACT

A cross is disclosed comprising two cross portions, each formed from a separate ring which is cut and straightened. The individual cross portions are then secured together in back-to-back relationship.

6 Claims, 1 Drawing Sheet

METHOD OF MANUFACTURING A CROSS FROM RINGS

BACKGROUND OF THE INVENTION

The present invention relates to new and useful improvements in jewelry and more specifically a cross made from two wedding rings.

FIELD OF THE INVENTION

This invention is specifically designed to provide the surviving spouse with a remembrance of his or her marriage. This remembrance is in the form of a cross made from the wedding rings of the deceased and surviving spouse. The rings are individually cut, straightened, formed into a cross and secured together in back to back relation, polished and provided with a loop to receive a neck chain.

With the above in mind, it is an object of the present invention to provide a novel piece of jewelry and method of making the same which may be worn by a surviving spouse as a fond memory of his or her marriage.

Another object of the present invention is to provide a novel cross structure of pleasant appearance made from wedding rings of a deceased and surviving spouse to be worn by the surviving spouse.

Other objects of the present invention will become apparent from the following description of the invention.

SUMMARY OF THE INVENTION

The jewelry item of this invention comprises a cross formed from two rings such as the wedding rings of a deceased spouse and the surviving spouse. Each ring is cut radially, straightened and cut into an upright member and two cross arms. The cross arms from each ring are fastened to the upright from the same ring forming two cross portions which are centered on one another and secured together in back to back relation to form the finished cross.

DETAILED DESCRIPTION OF THE INVENTION

Figure 1:
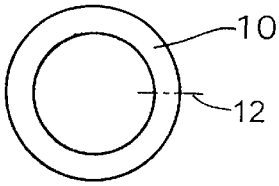
FIG. 1 is a plan view of the larger of a pair of wedding rings.
Figure 1A:
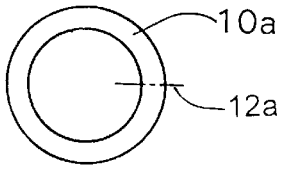
FIG. 1*a* is a plan view of the other wedding ring.
Figure 2:
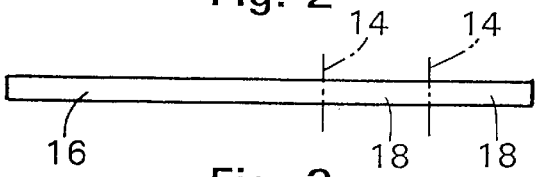
FIG. 2 is a face view of the ring of FIG. 1 in a straightened condition showing how it is to be cut.
Figure 2A:
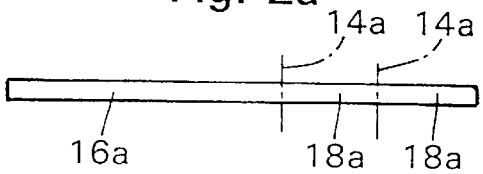
FIG. 2*a* is a view similar to FIG. 2 of the other ring.
Figure 3:
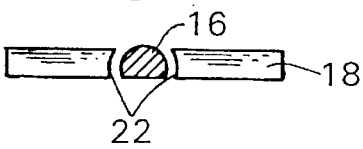
FIG. 3 is a sectional view through the upright member from one ring of the cross showing how the cross arms are contoured prior to attachment to the upright.
Figure 3A:
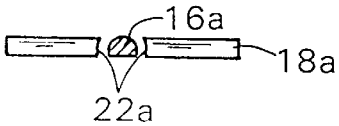
Figure 4:
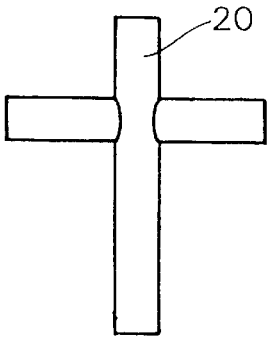
FIG. 4 is a face view of the assembled portion of the cross from one ring.

Referring more specifically to the drawings, FIGS. 1 and 1*a* illustrate respectively a man's and a woman's wedding ring 10 and 10*a* from which the jewelry item or cross of the present invention is to be formed. In producing the cross, each ring 10 and 10*a* is cut along a radial line as indicated at 12 and 12*a*. Both cut rings are thereafter straightened to form elongated rods as shown in FIGS. 2 and 2*a* which are cut transversely on lines 14 and 14*a* to form the upright members 16, 16*a* and pairs of cross arms 18, 18*a* which are thereafter assembled, as set forth below to form a first cross portion 20 from the man's ring and a normally slightly smaller cross portion 20*a* from the woman's ring.

After the upright portions 16, 16*a* and arms 18, 18*a* of the cross are cut, the arms are contoured as shown at 22 and 22*a* on the end facing the upright to conform to the transverse cross-sectional shape of the upright and are then secured to the upright, for example, by brazing to form a first cross portion 20 out of the ring 10 and a second cross portion 20*a* out of the ring 10*a*.

Figure 5:
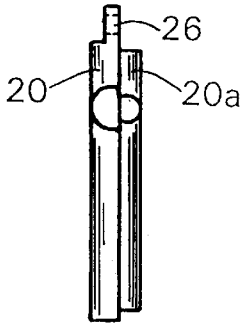
FIG. 5 is a side elevational view of an assembled cross.
Figure 6:
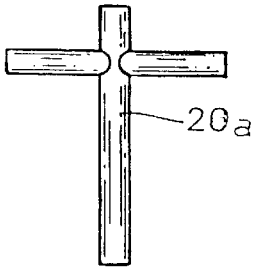
FIG. 6 is a face view of the assembled portion of the cross from the other ring.
Figure 7:
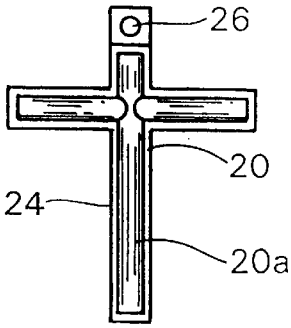
FIG. 7 is a view of the opposite face of a completed cross.

When the individual cross portions from each ring are completed, they are placed in back-to-back relation, as shown in FIG. 5 and secured together by brazing or other suitable means to form the finished cross 24. At the same time, a loop or ring 26 is formed in the upper end of the assembled cross to receive a chain for the purpose of wearing the cross. The two cross portions 20 and 20*a* will normally be slightly different in size because of different ring sizes, but are proportional to each other so that the smaller cross portion 20*a* is centered relative to the larger cross portion 20 as shown in FIG. 7. The finished cross 24 may then be polished and is ready for wearing.

While a particular embodiment of the present invention is illustrated and described herein as well as a method of forming the invention, changes and modifications may be incorporated and embodied therein within the scope of the following claims.

I claim:

1. A process for making a cross from a pair of wedding rings or the like comprising:

making a cut in each ring;

straightening each ring to form a continuous rod from each ring;

cutting each continuous rod to form an upright member and a pair of similar cross arms from each rod;

securing the cross arms to the upright member of their respective rods to form two cross portions, one from each ring; and securing the two cross portions together in back to back relation.

2. A process for making a cross in accordance with claim 1 wherein each ring is cut along a radial line.

3. A process for making a ring in accordance with claim 2 including contouring one end of each cross arm to conform to the transverse cross-sectional shape of its respective upright member prior to securing the arms to the upright member.

4. A process for making a cross in accordance with claim 3 including the step of centering the cross portions relative to each other prior to securing the cross portions together.

5. A process for making a cross in accordance with claim 4 wherein the cross arms are secured to the upright member by brazing and the cross portions are secured together by brazing.

6. A process for making a cross in accordance with claim 4 including the step of polishing the cross after the two cross portions are secured together.

* * * * *